United States Patent [19]

Suriano

[11] 4,040,283

[45] Aug. 9, 1977

[54] BENDING ROLLS MACHINE

[76] Inventor: Patsy Suriano, Suriano's Welding Service, 1219 Kennedy Blvd., Manville, N.J. 08835

[21] Appl. No.: 738,026

[22] Filed: Nov. 2, 1976

[51] Int. Cl.[2] ..... B21D 5/08

[52] U.S. Cl. ..... 72/175

[58] Field of Search ..... 72/170, 173–175

[56] References Cited

U.S. PATENT DOCUMENTS

| | | | |
|---|---|---|---|
| 1,868,341 | 7/1932 | Yates | 72/175 |
| 2,335,028 | 11/1943 | Rose et al. | 72/173 X |
| 2,467,671 | 4/1949 | Hulburt et al. | 72/175 |

*Primary Examiner*—Milton S. Mehr

[57] ABSTRACT

A bending rolls machine having the intermediate roll and shaft thereof driven from a "linking chain" by a gear located at the pivot point of a pivot member carrying the intermediate roll and shaft on the distal end of the pivot member, and the pivot-point gear being driven by another intermeshed engaged gear, and the two spaced-apart rolls being driven through a link-chain drive, and there being push buttons requiring pressure to continue to drive the rolls forwardly or alternately reversedly rotatably, and alternate automatic-run buttons for continuing to drive once initiated, and an emergency-stop lever-button to over-ride other buttons.

5 Claims, 3 Drawing Figures

FIG. 1
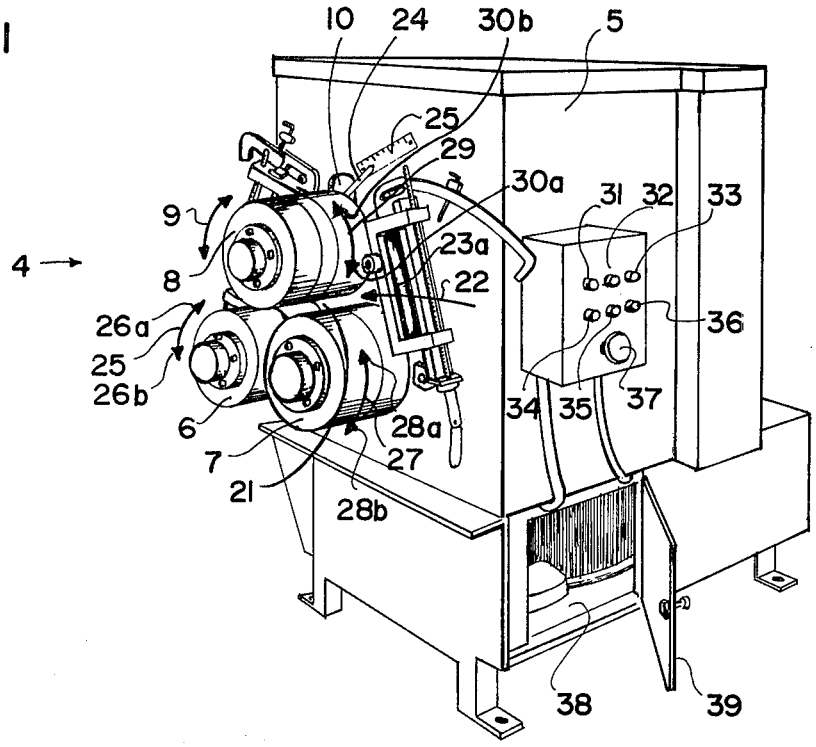
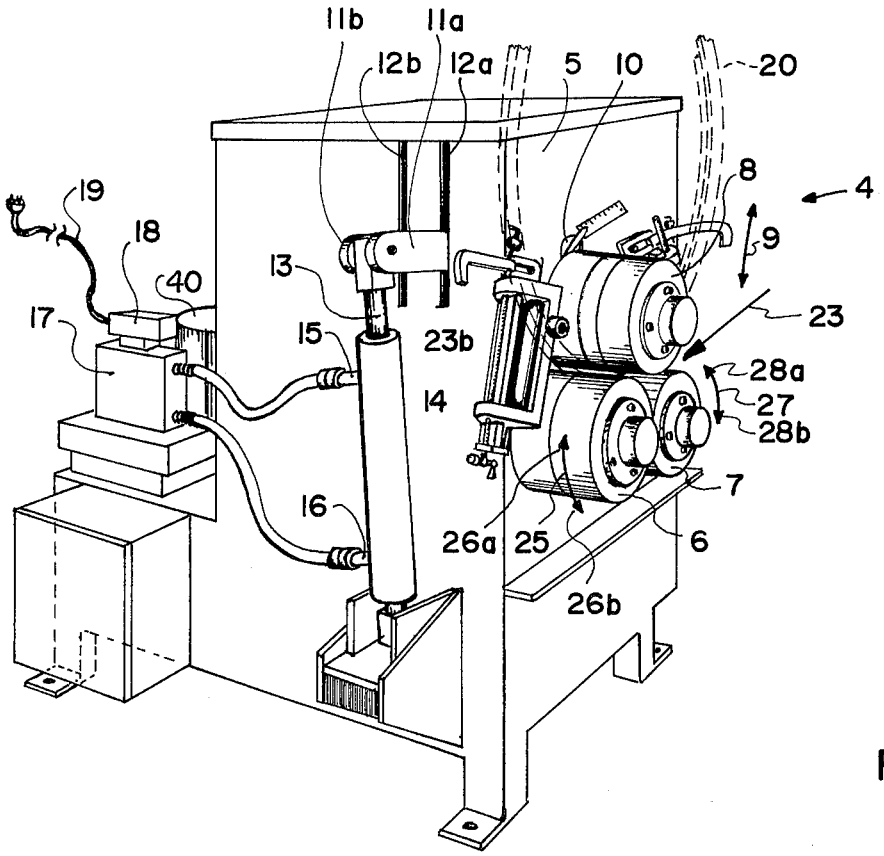
FIG. 2

BENDING ROLLS MACHINE

This invention relates to a bending rolls machine conventionally of the type for bending curves into elongated rails and/or bars.

BACKGROUND OF THE INVENTION

Prior to the present invention there have existed expensive and mechanically complicated bending rolls machines which characteristically are subject to frequent break-downs and excessive maintenance requirements, such being inherent in the nature of the machine as it has been assembled in the past. Torques on the shafts driving the respective rolls are very large in normal operation of this type of machine, and there results a constant wearing pressure on the gears and shafts thereof and mounting bearings thereof which aside from total break-down on occasions, more often results in poor engagement and consequent shearing of gear teeth or at least further loosening of engagement; such lax engagement causes both greater shocks to the remaining teeth and drive and bearing structures and more-importantly an unpredictable pressure by the bending rolls on the surfaces required to be pressed in order to bring about a proper bending of the rail or bar. Also, there heretofore has been a prevailing hazard to operators in poor control in and over the operation of such machines.

SUMMARY OF THE INVENTION

Accordingly, objects of the present invention include the avoiding and/or overcoming of problems and difficulties of the types discussed above.

Another object is to obtain a simplified construction and operation of a bending roll machine.

Another object is to obtain a driving mechanism for a bending roll machine, of a type not dependant upon any critical tolerance between driving parts thereof.

Another object is to obtain an effective and simple gear drive relationship to a pivoting roll-support.

Another object is to reduce dependance upon unworn parts for obtaining consistant and reliable bending pressures from bending rolls of a bending rolls machine.

Another object is to reduce each and both initial cost and maintenance expense of a bending roll machine.

Other objects become apparent from the preceding and following disclosure.

One or more objects are obtained by the typically illustrative embodiments as follow.

Broadly the invention may be defined as a bending rolls machine similar to existing machines in the location of two spaced-apart bending rolls on a forward face of the support structure, rotatable by respective shafts mounting the same, and in the location of the movable intermediate roll on its to-and-fro laterally movable shaft movable laterally along a length of a slot extending transversely to an imaginary straight (lineal) line extending between the two fixed rolls, the invention arising from the driving of the gear of the intermediate roll and shaft mounting that gear, being driven by a linking chain mounted on and between that gear and another gear located around the pivot shaft which serves also as the pivot point for the pivot member at the proximal end thereof, which pivot member carries the intermediate roll and shaft at the distal end thereof. By virtue of this chain drive, the pull through the chain is always with a taut relationship irrespective of worn bushings and bearings of the driving gear of the pivot shaft; such is in contrast to poor engagement and drive of tooth-to-tooth or gear-to-gear relationships when either or both engaging members are worn, or when the bushing and/or bearings are worn. This relationship is of particular importance at the pivot-point of the pivot member since through constant and repeated use thereof pivoting back and forth, and particularly in view of the very nature and purpose being to transmit excessively large pressures sufficient to bend large steel rails and/or bars and the like, there are tremendous torques placed on the pivot shaft typically, and on the prior art gear-to-gear engagement, causing excessive wear for those types of machines. To a lesser extent, but still to a significant degree, it is likewise important that the spaced-apart rolls be also each driven through link chains in order to assure always a constant predeterminable pressure of such rolls, also preventing distortions in the bending of rails and/or bars, etc..

In preferred embodiments, the gear of the pivot shaft is driven by a gear-to-gear relationship enabling easy and effective turning of the pivot member. Also, preferably the switching system of any conventional nature utilizes a pressure button for advancing the rolls in a forward direction of revolving so long as the button is pressed downwardly, as a manual-control button, and another such button for advancing the rolls in a rearward direction, but with corresponding automatic buttons for each respectively of initiating forward direction and initiating rearward direction of each of which when once initiated continuing automatically until turned-off or until a completion of a cycle, as the case may be, such being automatic-control buttons. Additionally, in contrast to the lack of such on prior machines of this type, there is an override circuit-breaking switch for emergency shut-down situations. Conventional lever means for initiating and causing the pivoting, and for driving by motor, may be used.

The invention may be better understood by reference to the Figures as follow.

THE FIGURES

FIG. 1 illustrates a front perspective side view of the bending machine in a preferred embodiment thereof.

FIG. 2 illustrates a view comparable to that of FIG. 1, except showing an alternate other side thereof in the perspective front view.

DETAILED DESCRIPTION

Figure 3:
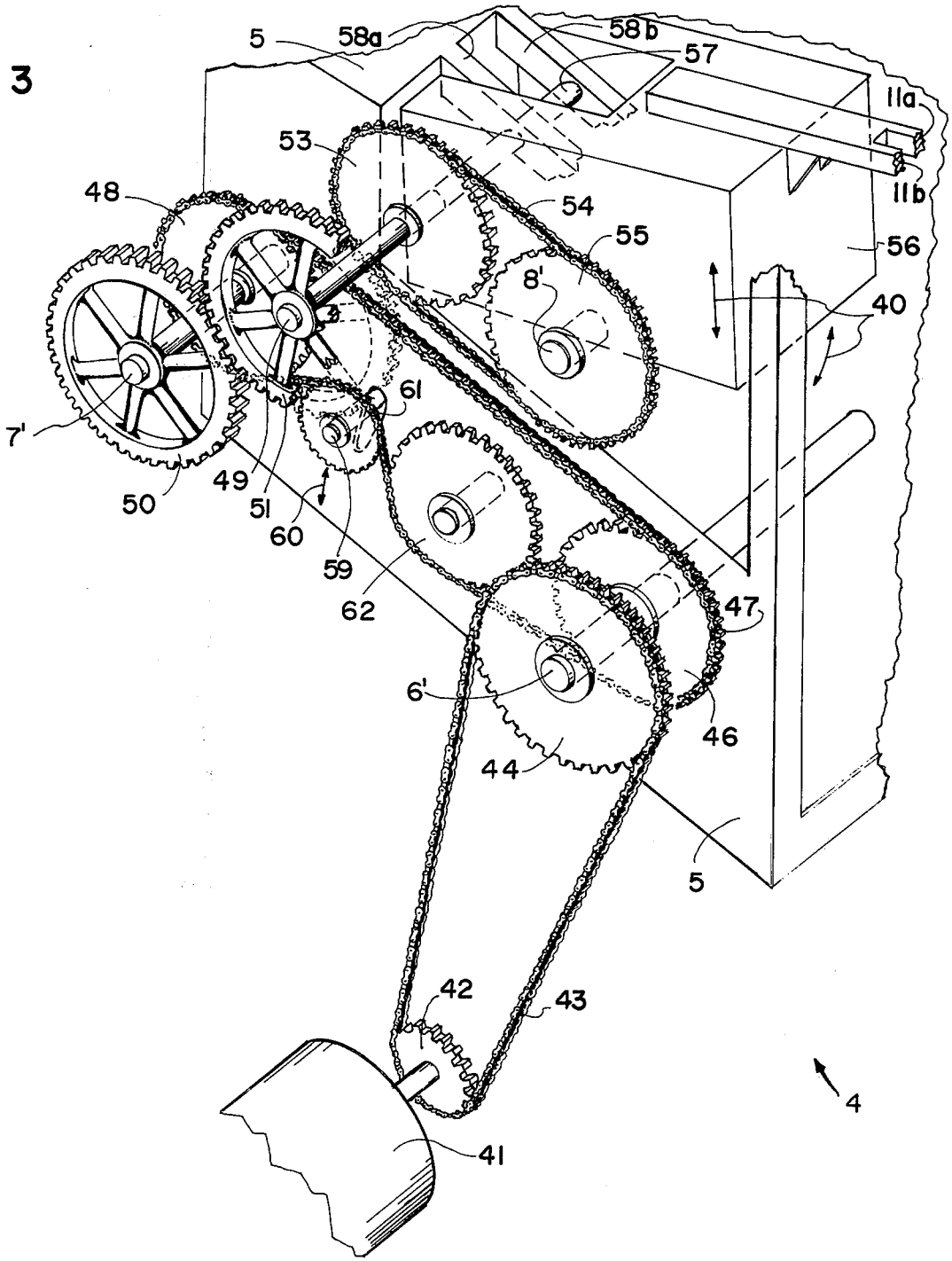
FIG. 3 illustrates a diagrammatic but not to scale, rear and side perspective in-part view of the machine of FIGS. 1 and 2, devoid of enclosing housing.

In greater detail, the bending rolls machine 4 includes a main support structure 5 having a lower, side storage compartment 38 and door 39 thereto, and having three conventional bending rolls mounted on a forward face thereof, driven by a novel drive mechanism and a novel switching mechanism, and having a novel measuring guage on the forward face of the support structure 5. In particular, there are fixed-position revolvable bending rolls 6 and 7 spaced-apart predetermined distances necessary for effecting travel and bending of bars by pressure of intermediate movable-position revolvable roll 8. Bending rolls 6 and 7 revolve in intermittently opposite clockwise and counter-clockwise directions 25 and 27, both simultaneously moving clockwise **26*a* and 28*a* directions, and both simultaneously moving counter-clockwise directions 26*b* and 28*b*. Bending roll 8 revolves in intermittently opposite counter-clockwise directions 29, moving counter-clockwise 30***a* when bending rolls 6 and 7 move move clockwise, and bending roll 8 moving clockwise 30*b* when bending rolls 6 and 7 move counter-clockwise. A rail or bar to be bent, travels against support rollers 23*a* and 23*b*, within space 22. Bending pressure and relief of pressure result from the bending roll 8 being changed in position in to and fro directions 9, the mounting drive shaft thereof moving along slot (elongated opening) in the forward face of the support structure 5. The gauge measuring scale 25 serves as an indicator for pointer 24 laterally movable with the drive shaft of the bending roll 8, whereby exact angle (degrees) of curvature to be imparted to a rail or bar may be predetermined. These elements are viewable in FIGS. 1 and 2.

As may be seen in FIG. 2, the piston cylinder-type hydraulic lift 14 has opposite-end fluid inlets 15 and 16, and also in conventional operation serving as outlets, for the fluid injector pump device 17 driven by a motor 18 powered by a typical power lead 19, for example. The roller drive mechanism is typically encased within rear encasing structure 10, together with portions of the gearing being within the substantially hollow support stucture 5. As the piston rod 13 reciprocates to and fro as controlled by control of the pump and valves thereof by suitable conventional control switches and mechanisms, the two spaced-apart levers-arms 11*a* and 11*b* are accordingly moved upwardly and downwardly within the respective slots 12*a* and 12*b*, with a resulting movement of the intermediate roller 8 in respective alternate directions 9.

These movements described thus far in this detailed description are nothing more than conventional operation the same as known prior art. The sole difference in so far as the front face is concerned, arises in the novel and beneficial scale 25 and pointer 24 described above, whereby for the phantom-line bar 20 of the FIG. 2, the curvature to be imparted can be thereby predetermined by adjustment of the correct positioning of the intermediate roller 8 responsive to the predetermined dimension per the pointer on the scale.

In FIG. 3, the support structure 5 is again identified, for understanding of the other relationships. The pivoting element 56 is pivotably mounted on drive shaft structure, identified as shaft element 57, which may be a casing around drive shaft 49 or alternately may be a part of the shaft 49 itself; the drive shaft is anchored in through-apertures of arm structures 58*a* and 58*b*. Drive shaft 8' is mounted within and extends through a distal portion of the pivoting element 56, and accordingly is raised and lowered therewith, as the appendage arms (lever-arms) 11*a* and 11*b* are raised or lowered, as the case may be, alternately in upward and downward directions. The drive shaft 8' has mounted on its forward end the bending roll 8 described above. The FIG. 3 illustrated shaft 7' has bending roll 7 mounted on its forward end, and the drive shaft 6' has drive bending roll 6 mounted on its forward end.

Gear 53 is fixedly mounted on the drive shaft 49 so as to rotate with the fixedly-mounted gear 51, and the gear 55 is fixedly mounted on the drive shaft 8' and driven through the link chain 54 by the drive gear 53; it will be noted that the driving of the gear 55 will always be by a firm unwaivering force by virtue of the taut nature of the chain during drive, irrespective of which direction the drive is taking place, i.e. whether forwardly or backwardly during the bending operation, such not being affected in the least detrimentally by virtue of wear and tear on the bearings, or the like by which the pivoting element 56 is mounted on the shaft element 57. The reverse drive — as compared to directions of the gears 46, 48 and 50 (as well as the slack-control gears and elements 59 and 62), for the gears 53 and 55, is obtained through the gear 61 acting with the teeth of gear 50, as motor 41 drives gear 42 and chain 43 and thereby gear 44 fixedly-mounted on shaft 6' to thereby drive fixedly-mounted gear 46, to drive chain 47 to drive gear 48 fixedly-mounted on shaft 7' to drive fixedly-mounted gear 50. The gear of spring-biased element 59 maintains chain 47 in a taut state by biasing the same in movement within slot 61, in a lateral (upward) direction between the gears 48 and 62. Accordingly, the pivoting element moves in directions 40, which for bending roll 8 corresponds to directions 8.

In FIG. 1, there is illustrated a typical and preferred control panel on the side face of the machine support structure 5. Operation of the machine is as follows; the button 31 is a selector button switchable between alternate positions "manual" and "automatic" operation; and when on manual, the bending rolls 6 and 7 move forwardly, i.e. counterclockwise, and the bender roll 8 moves forwardly, i.e. clockwise, so-long-as the forward button 32 is held in a pressed-down "go" state (i.e. turned-on state), and rearwardly when the reverse button 33 is held (pushed) in a pressed-down state. On automatic, the pushing of button 32 causes the bending rolls to move forwardly until subsequently the stop button 37 is pressed. In like manner, when button 31 is on automatic, the pressing (and then release of pressure) causes the machine to move in reverse until the stop button 37 is pressed.

The on-off button 34 turns-on and off the motor to the hydraulic pump. When the motor is turned on, pressing of button 35 causes the piston 13 to rise while the button 35 remains pressed, and similarly, pressing of button 36 causes the piston 13 to withdraw, i.e. lower, while the button 36 remains pressed. Heretofore no bending rolls machines have had the advantageous utility of the above-noted stop-button for automatic, and the manual operation controls, the present invention, together with also the hydraulic controls above-described, all conveniently commonly mounted within easy reach, may be safely and effectively and conveniently operated and controlled at all times.

In operation, the operation is substantially identical to that of any prior and/or conventional machines, in so far as the bending operations is concerned. However, the afore-mentioned advantages of the chain drives have positive results in making possible precise and predeterminable and reliable bending even after long continued use and wear, as has proven true on actual operating machines embodying the machine.

It is within the scope of the present invention to make such variations and modifications as might be apparent to a person or ordinary skill, including the substitution of equivalents.

I claim:

1. A bending rolls device comprising in combination: support structure having forward and rearward faces; spaced-apart first and second bending rolls and first and second shafts thereof each mounting fixedly its respective one of the first and second bending rolls, at forward ends of the respective first and second shafts respectively, and first and second gears each mounted fixedly on its respective one of the first and second shafts, the first and second shafts extending through the support structure with the first and second bending rolls located on the forward face and with the first and second gears located on the rearward face of the support structure, the support structure having a through-slot space formed therein extending through the support structure between the forward and rearward faces, with the length of the through-slot extending transversely to an imaginary line extending linearly between the first and second bending rolls; a third bending roll, a third gear, and a third shaft fixedly mounting the third bending roll on the forward face and the third gear on the rearward face, and the third shaft extending through said through-slot mounted movable transversely to the longitudinal axis of the third shaft along the length of the through-slot; a pivot member and pivot-point drive shaft pivotably mounting the pivot member thereon at a proximal end of the pivot member, the third shaft being mounted within a distal end of the pivot member, and a fourth gear mounted on the pivot-point drive shaft, and a linking chain mounted on and between and transmitable of driving force from one to the other of the fourth gear and the third gear; upon pivoting of the pivot member to and fro, the third shaft being movable to and fro along the length of the through-slot and movable of the third bending roll to and from a contacting state of contact with each of the first and second bending rolls; lever means for intermittently positioning the distal end in alternate to and fro positions; and drive means for driving the fourth gear and the first and second gears.

2. A bending rolls device of claim 1, in which said drive means includes a link-chain drive and a driving motor means for imparting driving force, with the link-chain drive connected to directly drive the first and second gears.

3. A bending rolls device of claim 2, in which said drive means further includes a fifth gear drivably intermeshed and engaged with said fourth gear.

4. A bending rolls device of claim 1, in which said drive means includes a fifth gear drivably intermeshed and engaged with said fourth gear.

5. A bending rolls device of claim 1, including switch means for alternate manual-operation run and automatic-operation run, and over-ride emergency-stop means.

* * * * *